US006336521B1

(12) United States Patent
Dennis

(10) Patent No.: US 6,336,521 B1
(45) Date of Patent: Jan. 8, 2002

(54) LADDER LEVELLING DEVICE

(76) Inventor: Martin C. Dennis, #2 - 1526 Arbutus Street, Vancouver, British Columbia (CA), V6J 3W9

( * ) Notice: Subject to any disclaimer, the term of this patent is extended or adjusted under 35 U.S.C. 154(b) by 0 days.

(21) Appl. No.: 09/660,843

(22) Filed: Sep. 13, 2000

Related U.S. Application Data

(63) Continuation-in-part of application No. 09/296,289, filed on Apr. 22, 1999, now abandoned.

(51) Int. Cl.[7] ..... E06C 7/00
(52) U.S. Cl. ..... 182/200; 248/188.3
(58) Field of Search ..... 182/200, 201, 182/202, 107; 248/188.3, 230.2, 231.31

(56) References Cited

U.S. PATENT DOCUMENTS

| | | | | | |
|---|---|---|---|---|---|
| 1,088,167 | A | * | 2/1914 | Osterhoudt | 182/200 |
| 1,127,287 | A | * | 2/1915 | Sadler | 182/200 |
| 3,021,921 | A | * | 2/1962 | Poelvoorde | 182/201 |
| 3,539,147 | A | * | 11/1970 | Morand | |
| 4,591,023 | A | * | 5/1986 | Hodson | 182/200 |

* cited by examiner

*Primary Examiner*—Alvin Chin-Shue

(57) ABSTRACT

Prior ladder levelling devices are difficult to adjust to a surface because it is necessary to unweight the ladder at the same time as adjusting. The present invention provides opposed locking brackets so that adjustment can be made by releasing a locking plate on just one bracket.

6 Claims, 7 Drawing Sheets

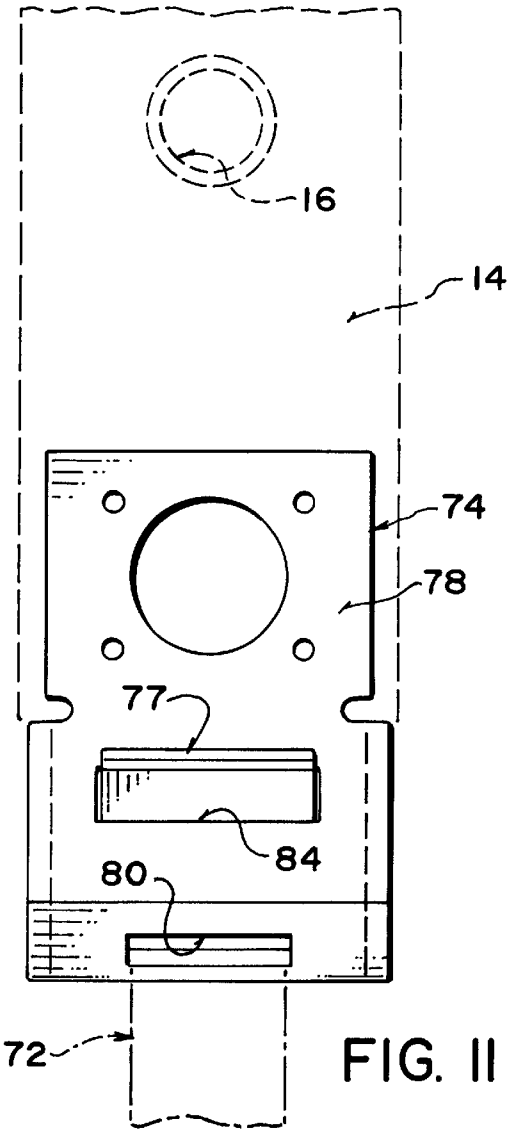
FIG. 11
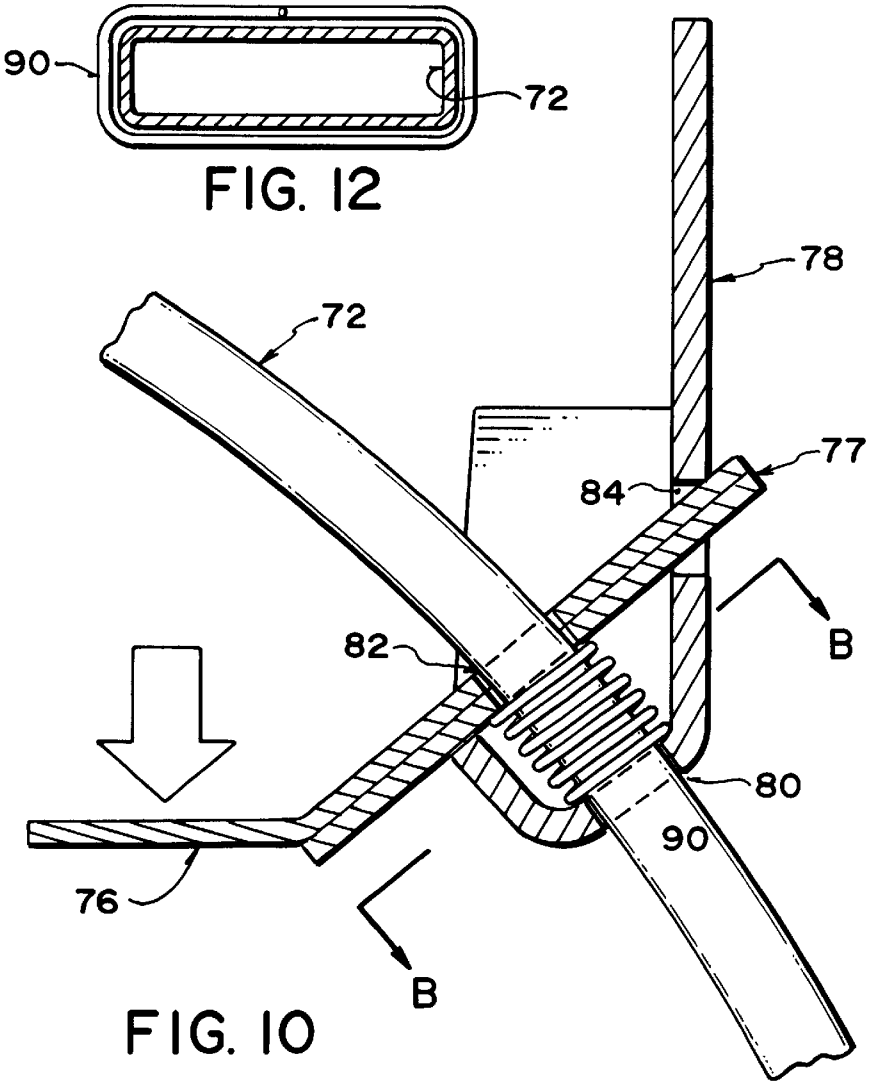
FIG. 10
FIG. 12

LADDER LEVELLING DEVICE

CROSS-REFERENCE TO RELATED APPLICATIONS

This application is a continuation-in-part of application Ser. No. 09/296,289 filed Apr. 22, 1999, which is abandoned.

TECHNICAL FIELD

The invention relates to devices which permit a ladder to stand level on an uneven surface.

BACKGROUND ART

Various devices are known to assist in supporting a ladder on an uneven or sloped surface. Hodson U.S. Pat. No. 4,456,095 issued Jun. 26, 1984 discloses one such device. It provides a frame for attachment to the legs of the ladder, with a support arc which is adjustable through the frame to raise or lower the feet of the support arc to accommodate irregularities in the supporting surface. This device however does not adapt to ladders of different widths. Hodson U.S. Pat. No. 4,591,023 issued May 27, 1986 discloses a levelling device for ladders which may be used on ladders of differing widths, but it is difficult to adjust this device, since it is necessary to lift the ladder to unweight the lugs which grip the arcuate support bar in order to adjust the support bar. There is therefore a need for a ladder levelling device which is easily adjustable to different surfaces. There is further a need for a ladder levelling device is easily adjustable to different surfaces and which adapts to ladders of differing widths.

DISCLOSURE OF INVENTION

The invention therefore provides a device for supporting in a level manner on an uneven surface a ladder having parallel side rails joined by rungs, the device comprising: i) an arcuate support member provided at either end thereof with ground-engaging feet; and ii) two opposed bracket means for adjustably and releasably securing the side rails of the ladder to the arcuate support member; wherein the bracket means each comprise: iii) securement means adapted for attaching to a side rail of a ladder; iv) a locking plate provided with an aperture for slidably receiving the arcuate support member, pivotally mounted in the securement means for pivotal movement between a first binding and locking position and a second releasing and adjusting position; and v) means for biasing the locking plates to bind against the arcuate support member and thereby secure the bracket member against movement relative to the arcuate support member in the biasing direction when the locking plate is in the locking position.

In a further aspect, the invention provides a device for supporting in a level manner on an uneven surface a ladder having parallel side rails joined by rungs, the device comprising: i) an arcuate support member provided at either end thereof with ground-engaging feet; and ii) opposed bracket means for adjustably and releasably securing the side rails of the ladder to the arcuate support member; wherein the bracket means each comprise: iii) a cylindrical housing releasably held in said bracket means and provided with apertures to receive said arcuate support member in a direction perpendicular to the central axis of said cylindrical housing; iv) a locking plate extending through and pivotally mounted in the cylindrical housing; and v) means for biasing the locking plates to bind against the arcuate support member and thereby secure the bracket member against movement relative to the arcuate support member in the biassing direction.

BRIEF DESCRIPTION OF DRAWINGS

In drawings which disclose a preferred embodiment of the invention:

FIG. 10 is a cross-section taken along lines C—C of FIG. 9;

FIG. 11 is a side elevation of the attachment bracket shown in FIG. 7 with the lower part of the ladder and the support arc shown in dotted outline;

FIG. 12 is a cross-section taken along lines B—B of FIG. 10.;

BEST MODE(S) FOR CARRYING OUT THE INVENTION

Figure 1:
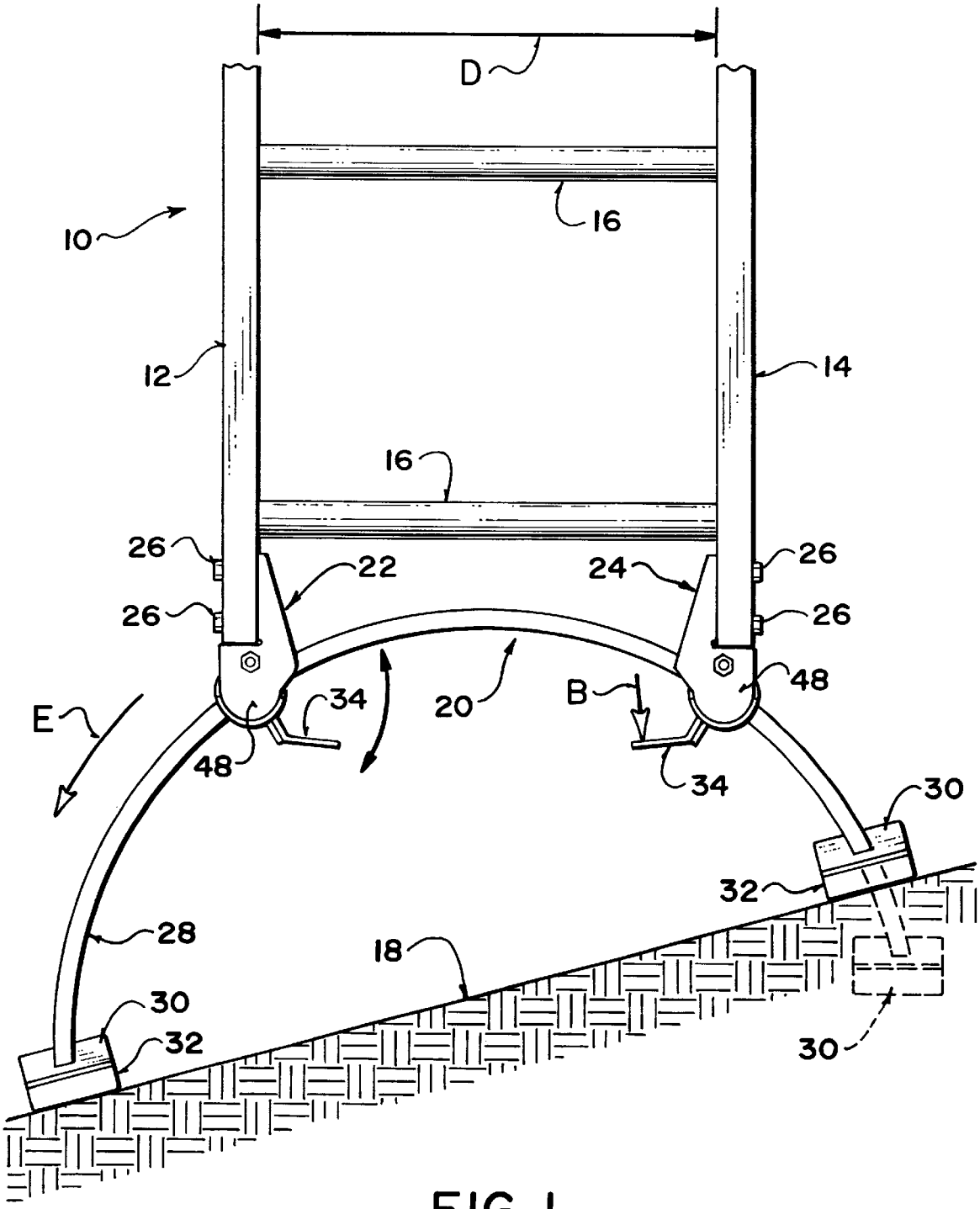
FIG. 1 is a front elevation of the lower part of a ladder and the levelling device of the invention.
Figure 2:
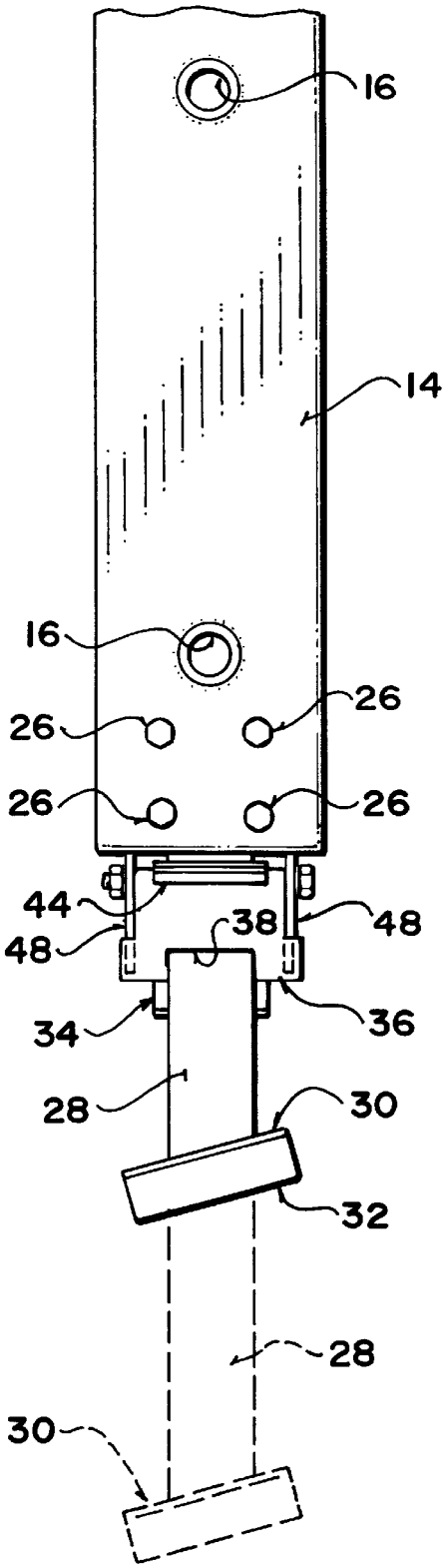
FIG. 2 is a side elevation of the lower part of a ladder and the levelling device shown in FIG. 1.
Figure 3:
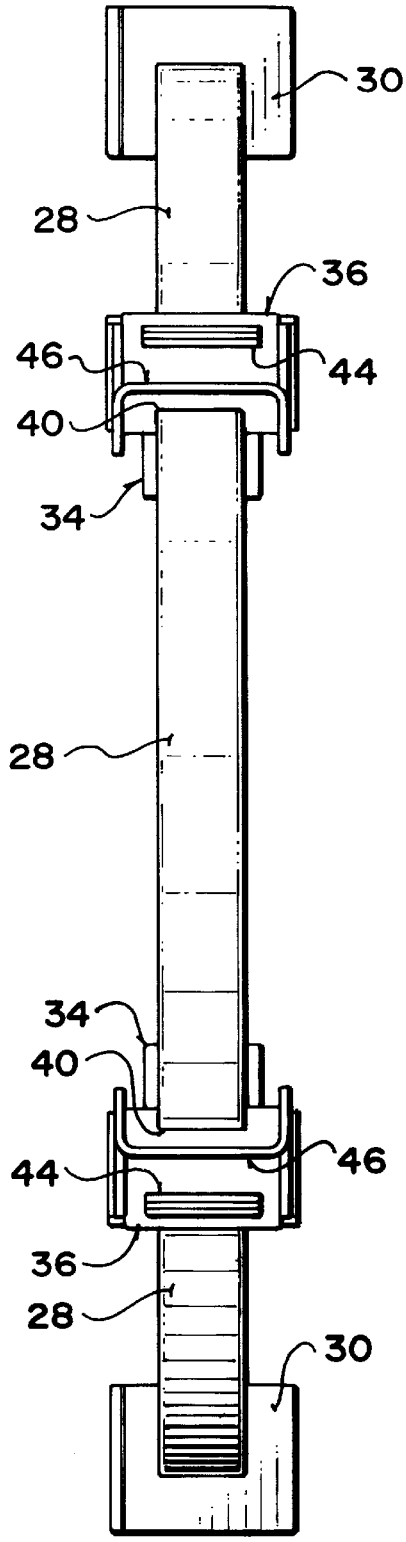
FIG. 3 is a top view of the levelling device of the invention.

With reference to the drawings, a ladder indicated at 10 has parallel side rails 12, 14 separated by a distance D, which is typically from 10 inches to 20 inches, and equally spaced rungs 16. Ground surface 18 is sloped and therefore unstable for a standard ladder. The ladder levelling device 20 is secured to the lower ends of side rails 12, 14 by bracket assemblies 22, 24 which are fastened to the ladder by bolts 26. It has a tubular support arch 28 which is preferably rectangular in cross-section, but may be other shapes in cross-section such as square, triangular or circular. The ends of support arch 28 are provided with feet 30 having rubber pads 32. Feet 30 are preferably fixed on the ends of arch 28 but could be made to pivot either in the plane of the arch or universally. As shown in FIG. 1, the support arch has been rotated in direction E, from the position shown in phantom outline to the actual position shown, to permit the rungs 16 of the ladder 10 to be horizontal while nonetheless both feet 30 are flat on the ground surface 18. Lever lock plates 34, described in further detail below, permit the support arch 28 to be selectively locked in place or released for adjustment.

Figure 4:
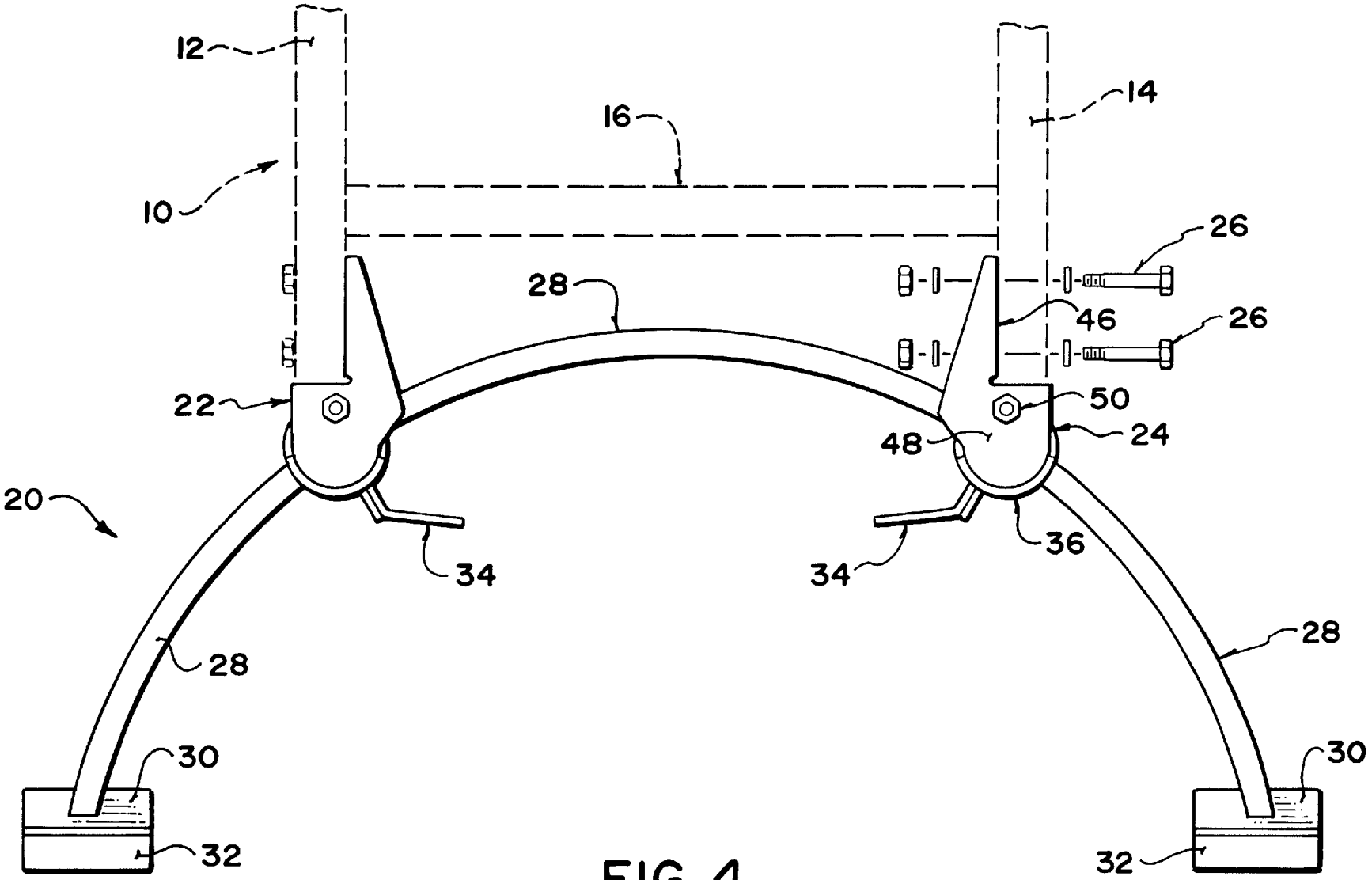
FIG. 4 is an exploded front elevation of the lower part of a ladder in phantom outline and the levelling device of the invention showing the fastening means.
Figure 6:
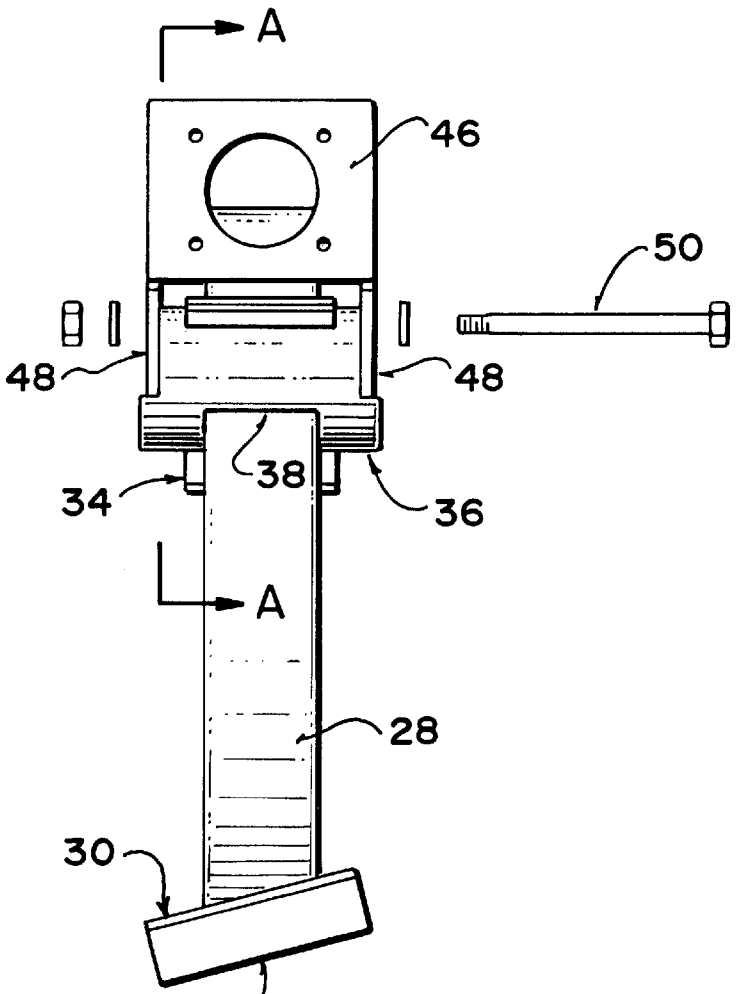
FIG. 6 is a side elevation of the levelling device shown in FIG. 4.
Figure 5:
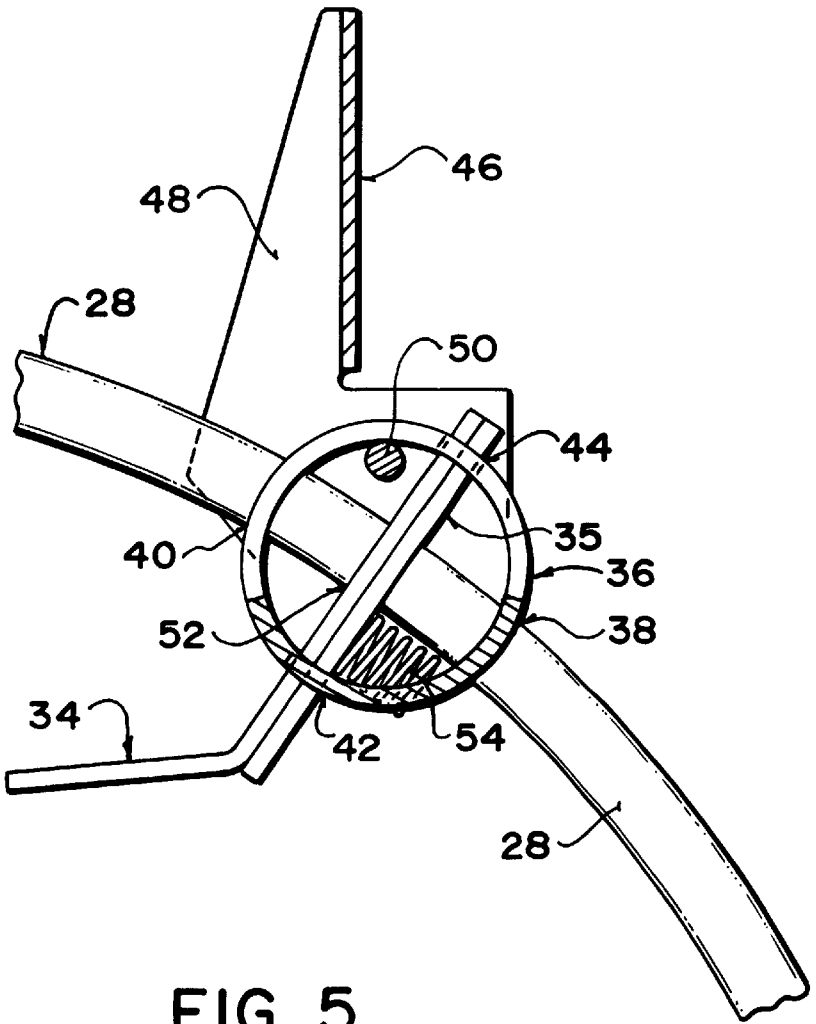
FIG. 5 is a detail view of the bracket assembly and lever lock plates partly in cross-section along lines A—A of FIG. 6.
Figure 7:
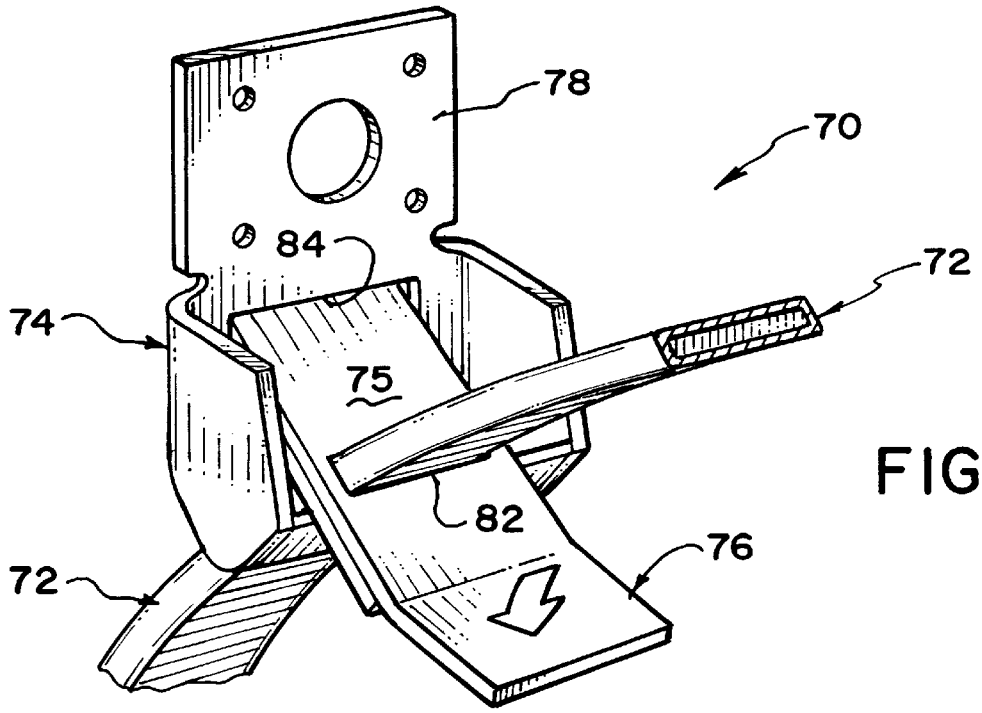
FIG. 7 is a perspective view partially cut away of the attachment bracket for a second embodiment of the invention used for ladders of fixed width.
Figure 8:
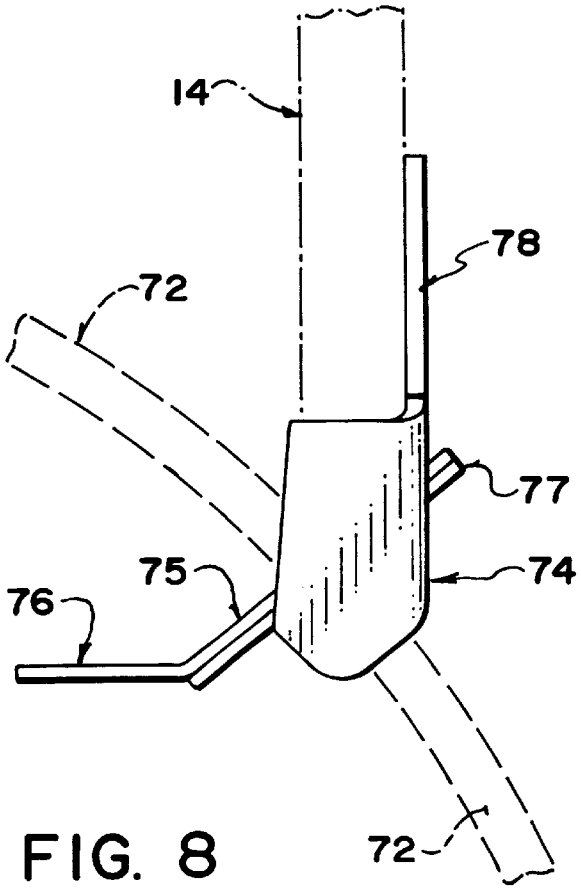
FIG. 8 is a front elevation of the attachment bracket shown in FIG. 7 with the lower part of the ladder and the support arc shown in dotted outline.
Figure 9:
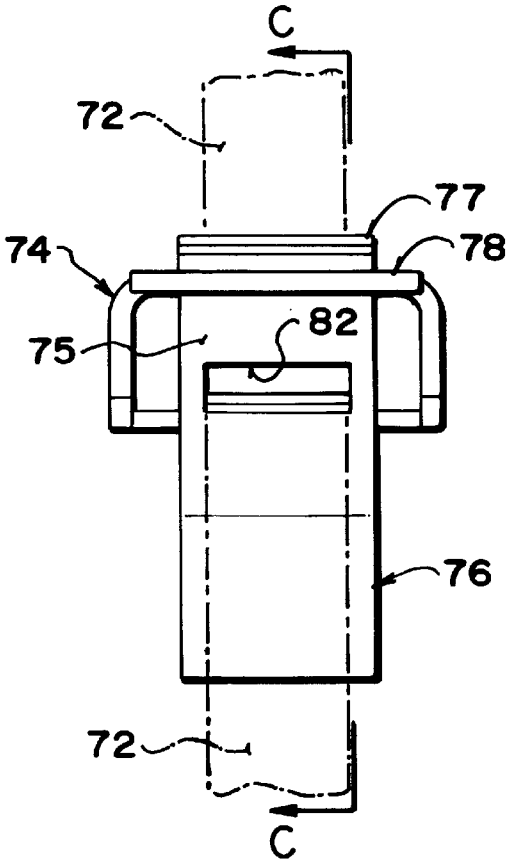
FIG. 9 is a top view of the attachment bracket shown in FIG. 7.

As shown in FIGS. 4 through 6, bracket assemblies 22, 24 each have a cylindrical housing 36 which has apertures 38, 40 through which the support arch 28 slides, and slots 42, 44 through which the lever lock plates 34 extend. Bracket assemblies 22, 24 have face plate 46 and side plates 48. Side plates 48 have rounded lower edges (FIG. 1 and FIG. 4). Through bolts 50 secure side plates 48 against cylindrical housing 36. Releasing bolts 50 allows the brackets to be adjusted to ladders of different widths, as described below. Lever lock plates 34 have a central aperture 52 through which support arch 28 can slide when lever lock plate 34 is perpendicular to support arch 28. A spring 54 presses against lever lock plate 34, which pivots about the end of plate 34 in slot 44, and has sufficient range of motion in slot 42 so that lever lock plate 34 binds against support arch 28 when the lever lock plate 34 is freely released, preventing motion along the support arch 28 in the direction away from spring 54 (the direction in which the lever lock plate is biassed by spring 54), but not in the direction towards spring 54.

Bracket assemblies 22, 24 are installed in opposing directions, thus preventing rotation of support arch 28 when both lever lock plates 34 are released. To adjust the device with the ladder 10 placed on uneven ground as in FIG. 1, the operator pushes down with one foot against the lever lock on the side with the higher terrain (arrow B) to disengage the lock and allow the support arch 28 to slide in direction E until the feet 30 are firmly on the ground and rungs 16 are horizontal. Lever lock plate 34 is then released and spring 54 forces it into binding engagement with support arch 28 to prevent movement. When weight is applied to the ladder 10, the binding force of lever locking plates 34 against the support arch 28 increases to further prevent slippage.

To adjust the device 20 to ladders of different widths, bolts 50 are loosened, permitting cylindrical housings 36 to rotate within brackets 22, 24. Brackets 22, 24 are then moved apart, or closer together the necessary distance so that when face plates 46 are secured to the legs 12, 14 of ladder 10, the radial portions 35 of lever lock plates 34 lie along the radius of support arch 28. Bolts 50 are then re-tightened so that cylindrical housing 36 is secured within brackets 22, 24 and the lower edge of side plate 48 bears down against cylindrical housing 36 when weight is placed on ladder 10.

FIGS. 7 through 12 illustrate an embodiment of the invention which is not adjustable to ladders of different widths. Levelling device 70 has support arch 72, two brackets 74 and two lever lock plates 76. Bracket 74 has a face plate 78 which is fastened to lower leg 14 of ladder 10. Support arch 72 extends through opening 80 in bracket 74 and through opening 82 in lever lock plate 76. The upper end 77 of lever lock plate 76 extends through and pivots in slot 84 in face plate 78. Spring 90 is located around support arch 72 extending between bracket 74 and lever lock plate 76.

In this embodiment the brackets 74 are configured so that when face plates 78 are secured to the legs 12, 14 of ladder 10, the radial portions 75 of lever lock plates 76 lie along the radius of support arch 72. Adjustment of the device to uneven surfaces is accomplished in the same way as the previous embodiment. Bracket assemblies 74 are installed in opposing directions, thus preventing rotation of support arch 72 when both lever lock plates 76 are released, since springs 90 cause lever lock plates to bind against support arch 72. To adjust the device with the ladder 10 placed on uneven ground, the operator pushes down with one foot against the lever lock 76 on the side with the higher terrain to disengage the lock 76 from support arch 72 and allow the ladder to slide around the support arch 72 until the feet 30 are firmly on the ground and rungs 16 are horizontal. The lever lock plate 76 is then released and spring 90 forces it into binding engagement with support arch 72 to prevent movement in the direction in which the lever lock plate is biassed by spring 90. When weight is applied to the ladder 10, again the binding force of lever locking plates 76 against the support arch 72 increases to further prevent slippage.

Figure 13:
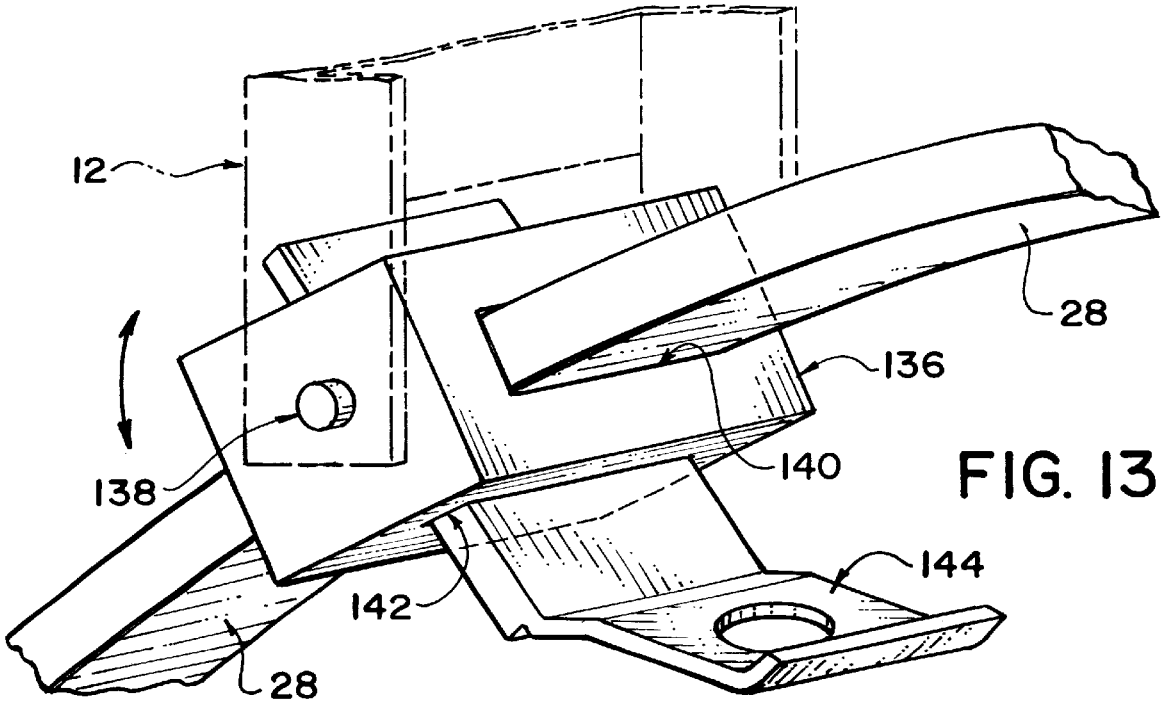
FIG. 13 is a detail in perspective view of a further embodiment of the attachment bracket.
Figure 14:
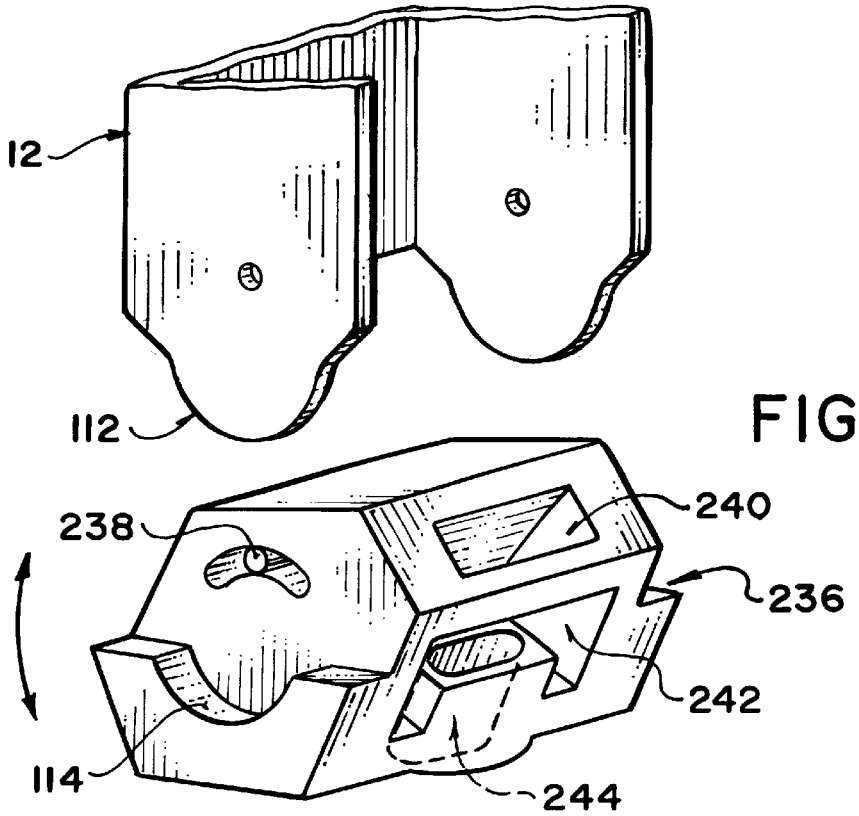
FIG. 14 is a detail in perspective view of yet a further embodiment of the attachment bracket.

FIGS. 13 and 14 illustrate alternative embodiments of brackets 22, 24 herein housing 36 is non-cylindrical. In FIG. 13, housing 136 is square or rectangular in cross-section. The ends of side rails 12, 14 are pivotally secured to housing 136 by pins 138. The support arch 28 slides through aperture 140. The lever lock plate 144 extends through slot 142. A spring (not shown) presses against lever lock plate 144 as in the previous embodiment. In FIG. 14, housing 236 is a solid plastic block, hexagonal in cross-section. The ends of side rails 12, 14 are pivotally secured to housing 236 by pins 238 and are radiused at 112 to fit and slide in correspondingly radiused shoulders 114 in housing 236. The support arch 28 slides through aperture 240. The lever lock plate (not shown) extends through slot 242. A spring to press against lever lock plate, as in the previous embodiments, is located in chamber 244.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. A device for supporting in a level manner on an uneven surface a ladder having parallel side rails joined by rungs, said device comprising:

i) an arcuate support member provided at either end thereof with ground-engaging feet; and ii) first and second opposed bracket means for adjustably and releasably securing said side rails of said ladder to said arcuate support member;

wherein said bracket means each comprise:

iii) securement means adapted for attaching to a side rail of a ladder;

iv) a locking plate provided with an aperture for slidably receiving said arcuate support member, pivotally mounted in said securement means for pivotal movement between a first binding and locking position wherein said bracket means is prevented from sliding on said arcuate support member in a first binding direction but is free to slide on said arcuate member in a second sliding direction opposite to said first direction, and a second releasing and adjusting position; and v) means for biasing said locking plates to bind against said arcuate support member and thereby secure said bracket member against movement relative to said arcuate support member in said first direction when said locking plate is in the locking position;

and wherein said first and second opposed bracket means are oriented in opposite directions on said arcuate support member so that said first binding direction of said first bracket member is directed in the second sliding direction of said second bracket member, and said first binding direction of said second bracket member is directed in the second sliding direction of said first bracket member;

wherein said securement means comprises a housing pivotally secured to the ends of said side rails and provided with two opposed apertures to receive said arcuate support member in a direction perpendicular to the central axis of said housing, and wherein said locking plates are pivotally mounted in said securement means by extending through radially opposed slots in said housing.

2. The device of claim 1 wherein said means for biasing said locking plates to bind against said arcuate support member and thereby secure said bracket member against movement relative to said arcuate support member in said first direction when said locking plate is in the locking position comprises a spring mounted to extend between said locking plate and said cylindrical housing.

3. The device of claim 1 wherein said housing is cylindrical.

4. The device of claim 1 wherein said housing is rectangular.

5. The device of claim 3 wherein said housing is releasably held in said bracket means by releasable side plates.

6. The device of claim 1 wherein said locking plates comprise a radial portion extending along a radius of said arcuate support member, and a handle portion extending at an obtuse angle to said radial portion.

* * * * *